US006000189A

United States Patent [19]

Breuer et al.

[11] Patent Number: 6,000,189

[45] Date of Patent: Dec. 14, 1999

[54] FIRE-RESISTANT REAR-VENTILATED CLADDING

[75] Inventors: Michael Breuer, Rottenburg; Gunnar Lahmann, Dresden; Hans-Peter Seelmann-Eggebert, Limburgerhof, all of Germany

[73] Assignee: Wolman GmbH, Sinzheim, Germany

[21] Appl. No.: 08/857,853

[22] Filed: May 16, 1997

[30] Foreign Application Priority Data

May 23, 1996 [DE] Germany ..... 196 20 893

[51] Int. Cl.[6] ..... B27N 9/00

[52] U.S. Cl. ..... 52/649.1; 52/659; 52/660; 52/676; 106/15.05; 106/18.15; 106/18.17; 106/18.18; 106/18.31; 106/18.32; 252/601; 252/606; 428/408; 428/920; 428/921

[58] Field of Search ..... 428/408, 920, 428/921; 252/601, 606; 106/15.05, 18.15, 18.17, 18.18, 18.31, 18.32; 52/659, 649.1, 660, 676

[56] References Cited

U.S. PATENT DOCUMENTS

| | | | |
|---|---|---|---|
| 2,795,260 | 7/1957 | Stilbert | 260/17.4 |
| 2,984,640 | 5/1961 | Kaplan | 260/33.4 |
| 3,284,216 | 11/1966 | Kaplan | 106/16 |
| 3,513,114 | 5/1970 | Hahn | 260/8 |
| 3,562,197 | 2/1971 | Sears et al. | 260/28.5 |
| 3,592,207 | 7/1971 | Borello | 137/1 |
| 3,654,190 | 4/1972 | Levine | 260/2.5 FP |
| 3,914,193 | 10/1975 | Fessler et al. | 260/17 R |
| 4,104,073 | 8/1978 | Koide et al. | 106/15 FP |
| 4,159,673 | 7/1979 | Weirich | 98/37 |
| 4,198,328 | 4/1980 | Bertelli et al. | 260/22 A |
| 4,367,295 | 1/1983 | von Bonin | 521/165 |
| 4,380,188 | 4/1983 | Nichols | 98/40 D |
| 4,645,782 | 2/1987 | Redfarn | 523/179 |
| 4,715,268 | 12/1987 | Tanner | 98/41.1 |
| 4,957,038 | 9/1990 | Hamilton | 98/87 |
| 5,225,464 | 7/1993 | Hill, Jr. | 524/100 |
| 5,387,655 | 2/1995 | Aslin | 525/511 |
| 5,401,793 | 3/1995 | Kobayashi et al. | 524/401 |
| 5,406,764 | 4/1995 | Van Auken et al. | 52/408 |
| 5,487,946 | 1/1996 | McGinniss et al. | 428/413 |

FOREIGN PATENT DOCUMENTS

685783 A5 9/1995 Switzerland .

*Primary Examiner*—Archene Turner
*Attorney, Agent, or Firm*—Oblon, Spivak, McClelland, Maier & Neustadt, P.C.

[57] ABSTRACT

Rear-ventilated cladding is provided with intumescent compositions in the region of the rear ventilation.

17 Claims, No Drawings

FIRE-RESISTANT REAR-VENTILATED CLADDING

DESCRIPTION

The present invention relates to rear-ventilated cladding which is provided with an intumescent composition in the region of the rear ventilation.

The present invention furthermore relates to construction elements for rear-ventilated cladding in which at least one ventilation device or spacer profile which allows the passage of air is provided with an intumescent composition, to the use of intumescent compositions for coating ventilation devices or profiles for rear-ventilated cladding, to the use of ventilation devices and profiles which contain at least one layer of an intumescent composition for the production of rear-ventilated cladding, and to a process for conferring fire resistance on rear-ventilated cladding which comprises providing cladding elements with an intumescent composition in the region of the rear ventilation.

The use of intumescent compositions in fire protection for buildings is disclosed, for example, in EP-A-694 574.

The term intumescent compositions is taken to mean materials which expand on exposure to heat and form an insulating and heat-resistant foam ("thermofoam") which protects the underlying surfaces and substrates against the action of fire and heat. In addition to the classical three-component mixture of carbon donor, dehydration agents and blowing agents, for example sugar, ammonium phosphate and melamine, two-component systems have also been developed, for example melamine phosphate mixed with boric acid, and even one-component materials are increasingly being used. The latter include expandable mica, expandable graphite, perlite, crude vermiculite, inter alia, in addition to the long-known alkali metal silicates "water glass".

In fire protection for buildings, the intumescent compositions are used in the form of paints, varnishes, coatings, pastes, putties, mortars, seals, sheets, panels, strips, foams, webs, films, profiles and other semi-finished articles.

The aim when using intumescent compositions (also known as insulation layer formers) is to improve the fire resistance of components or elements or to achieve a better fire classification of building materials.

Rear-ventilated cladding generally consists of an insulation layer, an outward-facing protective and decorative layer and a cavity between the layers or between these layers and the building surface. This cavity is screened against insects, dirt particles, etc, by holed profiles made of steel, aluminum, wood or plastic, grids or meshes installed between the cladding supports in such a way that adequate rear ventilation is achieved. These ventilation devices and profiles can serve for mechanical stabilization of the cladding, but must allow the passage of air in order to enable significant replacement of air within the cavity. In general, holed profiles are therefore used as spacers.

Rear-ventilated cladding is widely used in particular on the outside of buildings. This type of cladding has various advantageous properties, such as thermal insulation and protection against weathering influences, and, due to the rear ventilation, prevents the formation of damp chambers. Embodiments of such cladding systems are described, for example, in DE-A-4 212 930. However, the rear-ventilated cladding disclosed hitherto has the disadvantage of providing only inadequate protection in the event of fire, when strong chimney-like air currents form in the rear-ventilation system owing to the strong evolution of heat, fan the source of the fire and can contribute to spread of the fire. In particular in the case of rear-ventilated cladding containing combustible thermal insulation material, the spread of a fire is therefore frequently favored.

It is an object of the present invention to provide rear-ventilated cladding with reliable fire protection. We have found that this object is achieved by the rear-ventilated cladding described at the outset.

In contrast to rear-ventilated cladding having a surface coating with flame retardants, the novel solution of using fire-resistant ventilation devices and profiles offers particularly effective and economical fire protection and drastically reduces the spread of sources of fire.

The ventilation devices and profiles can be provided with fire protection in various ways. For example, rear-ventilated cladding and ventilation devices and profiles thereof can advantageously be coated with an intumescent composition. The coating can be applied, for example, by brushing, rolling, knife coating, spraying—by means of compressed gases or preferably by means of the airless method—or by dipping. In order to increase the weathering resistance, a topcoat, for example a paint, can also be applied to the intumescent layer.

A particularly simple and effective way of conferring fire protection on rear-ventilated cladding is to provide the ventilation devices and profiles with intumescent adhesive strips. Adhesive strips of this type are commercially available. Exterdens® F self-adhesive strips from Dr. Wolman GmbH are particularly suitable, since they have good long-term stability in addition to favorable fire-protection properties. It is important here that, in order to avoid impairing the rear-ventilation effect, the air openings in the ventilation devices and profiles are not completely closed by the adhesive strips. However, most commercially available intumescent adhesive strips exhibit such pronounced expansion behavior in the event of fire that bonding of the strips to a small part of the profile area is sufficient to effect substantial sealing of the profile in the event of fire and thus to prevent spread of the fire.

A particularly economical form of fire protection for rear-ventilated cladding is to apply glass-fiber, plastic or wire meshes coated with intumescent composition between the cladding supports. These meshes seal the cavities in the event of fire through their thermofoam.

A further novel embodiment for rear-ventilated cladding is to use spacer profiles in the form of holed panels or grids which may be angled or have a U-shape and are made of a composite material containing at least one intumescent layer.

The base material for such a composite material can be any synthetic plastics, for example polycondensates, polyaddition products and polyadducts, such as epoxy resins or crosslinked polyurethanes, preferably thermoplastic polymers, for example polyesters, polyethers, polyether ketones, polyamides and preferably polystyrenes, vinyl chloride polymers and polyolefins. Highly suitable polyolefins are described, for example, in Ullmann's Encyclopedia of Industrial Chemistry, 5th Edition, Volume A21, pages 488 to 546, VCH 1992. Suitable vinyl chloride polymers and suitable styrene polymers (polystyrenes) are described, for example in Saechtling, Kunststofftaschenbuch, 23rd Edition, pp. 241 ff and pp. 253 ff (1986).

Preferred composite materials contain at least 50% by weight, based on the total weight of the novel plastic layered article, of a thermoplastic, preferably polyolefin or vinyl chloride polymer, in particular PE-HD, or polyvinyl chloride (PVC).

Of the vinyl chloride polymers, those which can be thermoplastically processed at below 200° C. are particularly suitable.

The plastic component is preferably a vinyl chloride polymer having a K value, measured in accordance with DIN 7749, in the range from 10 to 100, preferably in the range from 55 to 80. PVC dispersions in high-boiling solvents with added plasticizers, known as plastisols, are particularly suitable.

The spacer profiles made from composite material can be produced in various ways, which are known in general terms to the person skilled in the art.

Firstly, a plastic molding can be produced from the plastics described by known processes, such as extrusion, blow molding or lamination. In some cases, the plastic molding should be pretreated, for example by flame treatment, corona treatment, by mechanical pretreatment, for example by roughening, or by chemical methods. Examples of chemical pretreatment methods which may be mentioned are halogenation, priming with adhesion promoters, treatment with ethylene comonomer rubbers, with polyaminoamides, with acrylate copolymers, with polyethyleneimines or with oleum or $SO_3$.

The intumescent layer can be applied to this base structure by brushing, rolling, knife coating, spraying—by means of compressed gases or preferably by means of the airless method—or by dipping methods. If desired, further layers can then be applied to the intumescent layer.

In particular in the case of thermoplastics, a further suitable process for producing the intumescent layer(s) besides conventional thermoplastic processing methods, such as injection molding or blow molding, is preferably coextrusion of the plastics with the intumescent composition. Examples of plastics which are highly suitable for coextrusion are the abovementioned polyolefins, in particular the ethylene polymers and the abovementioned vinyl chloride polymers.

The thickness of the intermittent layer(s) in the ventilation devices and profiles is in the range from 0.05 to 5.0 mm, preferably in the range from 0.2 to 0.6 mm.

Further details on suitable composite materials and on the preparation of intumescent compositions are given in the earlier German Patent Application No. 196 17 592.5.

In principle, the intumescent compositions used in the novel rear-ventilated cladding can be all known compositions of this type. Intumescent compositions having a strong expansion behavior and good weathering resistance are particularly suitable. Examples of suitable intumescent compositions are those which contain expandable graphite. Expandable graphite has such a pronounced expansion behavior that it frequently represents effective fire protection for rear-ventilated cladding on its own. Advantageous compositions are also those which comprise the following components:

a) a phosphorus-containing nitrogen compound, b) a polyalcohol, c) a blowing agent, and d) if desired further additives.

In intumescent mixtures which are particularly suitable for the purposes of the present invention, the phosphorus-containing nitrogen compound a) is an ammonium, melamine, dimelamine, urea, dicyandiamide, carbamide or guanidine phosphate, or a mixture thereof. Preferred compounds a) are ammonium polyphosphates and melamine phosphates, and mixtures thereof.

The content of component a) in the intumescent mixture is generally from 2 to 50% by weight, preferably from 11 to 40% by weight, based on the mixture a) to d).

Suitable polyalcohols b) are glycerol, glycerol derivatives, trimethylolethane, trimethylolpropane, tetraphenylethylene glycol, ditrimethylolpropane, 2,2-dimethylolbutanol, dipentaerythritol, tripentaerythritol, EO/PO-trimethylolpropane, EO/PO-pentaerythritol, sugars, polysaccharides such as starch and cellulose, and mixtures thereof.

Preference is given to low-solubility polyalcohols, such as pentaerythritol, or mixtures thereof.

The content of component b) in the intumescent mixture is generally from 2 to 30% by weight, preferably from 5 to 18% by weight, based on the mixture a) to d).

Suitable blowing agents c) are melamine derivatives, for example melamine cyanurates, melamine phosphates, melamine borates and low- and high-molecular weight polyethyleneimines, and compounds which eliminate $CO_2$ or water at elevated temperatures, such as carboxylic acids, dicarboxylic acids, derivatives thereof and inorganic salts, such as $CaCO_3$ and ammonium carbonate.

Preference is given to nitrogen compounds which have low solubility in water, such as melamine and melamine cyanurate, or mixtures thereof.

The content of component c) in the intumescent mixture is generally from 2 to 15% by weight, preferably from 2 to 10% by weight, based on the mixture a) to d).

It has been found advantageous for the intumescent mixture also to contain additives as component d), for example substances which develop an expansion pressure, such as expandable graphite, inorganic fillers, such as calcium carbonate, water-liberating substances, such as aluminum hydroxide, magnesium hydroxide, calcium hydroxide and barium hydroxide, preferably aluminum hydroxide or magnesium hydroxide, furthermore plasticizers, thickeners, flow-control agents, antifoams, adhesion promoters and in particular rheological additives.

Other suitable fire-protection additives are, for example, boron compounds, such as boric acid, metal borates, aminoborates and boranes, organohalogen compounds, such as highly chlorinated aliphatic hydrocarbons, aliphatic and aromatic bromine compounds (for example hexabromocyclododecane) and chlorinated paraffins, metallocenes, such as ferrocene, azidodicarboxylic acid diamides, red phosphorus and organophosphorus compounds, such as chlorine-containing phosphorus polyols based on oligomeric phosphates.

The total amount of components d) in the advantageous mixture can be from 0 to 60% by weight, preferably from 0.5 to 50% by weight, based on the mixture a) to d).

The proportion by weight of the component which develops an expansion pressure and inorganic fillers or water-liberating substances, based on the total weight of component d), is usually in the range from 20 to 60% by weight, preferably in the range from 30 to 50% by weight, based on the total weight of component d).

Particularly suitable intumescent composite materials comprise a plastisol, as defined above, as the plastic component, ammonium phosphate as component a), dipentaerythritol as component b), dicyandiamide as component c) and expandable graphite and aluminum hydroxide as component d).

In principle, the novel rear-ventilated cladding is suitable for interior and exterior cladding of buildings. However, this cladding offers particular advantages in the exterior area, since that is where thermal insulation and weathering resistance are particularly important.

Rear-ventilated cladding is usually constructed from ready-made elements. It is particularly advantageous in accordance with the invention to provide these construction elements in advance with intumescent compositions in the region of the rear ventilation.

Preference is given to construction elements in which at least one ventilation device or profile which allows the passage of air is provided with an intumescent composition.

EXAMPLES

The fire tests were carried out in the following test set-up: 4 steel brackets with an arm length of 5 mm were screwed as supports to two fire-resistant walls (200×300×30 cm) parallel to one another at a separation of 10 cm. The spacer profile (holed panel 4/6) measuring 200×100×2 mm was placed on these steel brackets.

Example 1

Coating of a profile with intumescent self-adhesive tapes with about 50% of the hole area covered. The intumescent strips used were the abovementioned commercially available Exterdens® and Exterdens® F-M1 self-adhesive tapes.

These holed profiles were treated from below with a Bunsen flame. The distance from the upper edge of the Bunsen flame to the panel was in each case 10 cm. After 60 seconds, the strips had foamed, and the holes in the profile were completely blocked. The temperature on the side facing away from the flame was between 145 and 165° C. after flame treatment for 30 minutes.

Example 2

Analogously to Example 1, a profile measuring 200×100×3 mm was provided with self-adhesive strips (width: 10 mm, thickness: 2 mm) of the following composition:

| | |
|---|---|
| PVC-E powder Vinnolit ® 44472 (Vinnolit Kunststoff GmbBH) | 22.00% |
| Tricresyl phosphate, Disflamol ® TKP (Bayer AG) | 15.60% |
| Dibutyl phthalate | 6.40% |
| Aluminum hydroxide | 3.00% |
| Ammonium polyphosphate | 23.32% |
| Melamine cyanurate | 16.96% |
| Pentaerythritol | 12.72% |

The profile was placed on the abovementioned supports and treated from below with an Infra-Boy® SLR heat emitter (initial gas pressure 50 mbar, surface temperature of the emitter surface 800° C.).

The distance between the emitter surface and the profile was 17 cm. After heating for a few seconds, intumescence commenced. After about 2 minutes, the holes were completely blocked with foam.

The maximum temperature on the side facing away from the emitter was 140° C. after heating for 30 minutes.

Example 3

Ventilation device with an intumescent coating A profile (holed panel 4/6) measuring 200×100×3 mm (analogously to Example 1) was provided on both sides with an intumescent coating having the following composition:

| | |
|---|---|
| Water | 20.80% |
| Tylose | 3.00% |

-continued

| | |
|---|---|
| Disperbyk ®, alkylolammonium salt (Byk-Chemie GmbH) | 0.20% |
| Titanium dioxide | 4.00% |
| Pentaerythritol | 12.00% |
| Ammonium polyphosphate, Hostaflam ® AP 422 (Hoechst AG, Frankfurt) | 24.00% |
| Melamine | 14.00% |
| Mowilith ® DW460, polyvinyl acetate dispersion (Hoechst AG) | 20.00% |
| Cereclor 60 L $C_{10}$–$C_{13}$ chlorinated paraffin, C content 60% (Deutsche ICI GmbH, Frankfurt) | 2.00% |

at a wet application rate of 400 g/m$^2$, and, after drying overnight, was treated with a Bunsen flame from below as described in Example 1.

The fire test was terminated after 32 minutes. A temperature of 185° C. was measured on the side facing away from the fire toward the end of the test.

Example 4

A ventilation device in the form of a commercially available glass-fiber mesh (mesh width 0.5 mm, thickness 0.2 mm) was impregnated (application rate about 350 g/m$^2$, wet) with an intumescent composition having the following composition:

| | |
|---|---|
| Epoxy resin, epoxide value 0.2–0.0225, Hydroxide value about 0.23, Eurepox ® 7001 (Schering AG) | 31.00% |
| Aluminum hydroxide, | 6.50% |
| Expandable natural graphite, C content > 95% (Georg Luh GmbH, 65396 Walluf) | 6.85% |
| Dipentaerythritol | 1.05% |
| Melamine | 0.16% |
| Ammonium polyphosphate | 0.39% |
| Xylene | 14.05% |
| Bitumen, Spezial Tar ® No. 1 (Worlée-Chemie, Hamburg) | 20.00% |
| Polyamine curing agent, polyamidoamide adduct Euredur ® 423 (Schering AG) | 20.00% |

After this coated glass fiber material measuring 200×100×2 mm and been fixed in the above supports, it was heated as described in Example 2. The temperature of the emitter surface was 500° C. The distance of the heat emitter from the cladding segment was 17 cm.

The intumescence commenced after a few seconds. The mesh structure was sealed over its entire area after about 2 minutes. The maximum temperature on the side facing away from the emitter was 155° C. after 15 minutes.

Example 5

Coating of a Profile with Intumescent Pastes

The commercially available intumescent paste Interdens® type 40 (manufacturer: Dr. Wolman GmbH, Sinzheim) and an intumescent paste having the following formulation were applied to a spacer profile as described in Example 1:

| | |
|---|---|
| Polyvinyl alcohol, partially hydrolyzed, Mowiol ® 3-83 (Hoechst AG) | 25.00% |
| Monoamonium phosphate | 22.88% |
| Dicyandiamide | 16.64% |
| Pentaerythritol | 12.48% |
| Ammonium polyphosphate | 8.80% |

-continued

| | |
|---|---|
| Colanylschwarz ® PR 100 (Hoechst AG) | |
| Expandable natural graphite, C content > 95% (Tropag, O. Ritter Nachf. GmbH) | |
| Aminoborate solution | 1.00% |
| Kelzan ® S, polysaccharide thickener, (Lanco, Ritterhude) | 1.00% |
| Water | 3.30% |

The pastes were applied to the panel using a cartridge (nozzle diameter 8.0 mm) as an S-shaped bead (bend diameter about 4 cm). After drying, a Bunsen burner test was carried out as described in Example 1.

The commencement of thermofoam formation was again observed after a few seconds. After 2 minutes, the holes were completely covered by the bulky thermofoam.

After 30 minutes, the temperature on the side facing away from the fire was 160° C.

Example 6

Ventilation device made from PVC composite material measuring 200×100×6 mm

An intumescent composition having the following composition was applied to both sides of a rigid PVC sheet Vinnoflex® S 6515 (BASF AG) by roll coating:

| | |
|---|---|
| Phosphate ester, Disflamol ® TKP (Bayer AG) | 15.00% |
| Aluminum hydroxide | 39.34% |
| Zinc borate | 1.06% |
| Expandable natural graphite, C content > 95% | 14.60% |
| Erpan ® MBS (Tropag, O. Ritter Nachf. GmbH) | |
| Monoammonium phosphate | 7.50% |
| PVC resin, Vinnolit ® P 4472 (Vinnolit Kunststoff GmbH) | 22.50% |

Rigid PVC/intumescent composition mixing ratio by weight 60:40 and pressed.

| | |
|---|---|
| Rolling conditions: | 8 minutes at 180° C |
| Pressing conditions at 170° C.: | 3 minutes temperature equalization, 3 minutes at 200 bar, without filter paper |

The intumescent layer of the PVC composite material was in each case 1.5 mm in thickness under these conditions. Holes having a diameter of 4.0 mm were drilled at regular intervals of 6.0 mm in the composite material boards measuring 200×100×6 mm. The rows of holes were offset with respect to one another so that the largest possible number of holes was achieved.

A composite material board prepared in this way was placed on the abovementioned supports and treated from below with a Bunsen flame (as described in Example 1). The intumescence commenced immediately, and after a few minutes all the holes were blocked by foam and the chamber sealed. After the experiment was complete, a temperature of 178° C. was measured on the side facing away from the fire.

Example 7

Fire Test on Rear-Ventilated Cladding

A practical trial was carried out on rear-ventilated cladding. The substructure comprised aluminum T-profiles attached by means of wall supports. The thermal insulation comprised rockwool boards covered by glass nonwoven material (rockwool density about 25–40 kg/m$^3$). Plaster cladding elements, made from recycled waste glass and plastered on one side with WDVS plaster (manufacturer of the board: StoVerotec, Germany), were attached to the subconstruction by means of dry wall screws. The distance between the plaster cladding and the rockwool boards was about 2 cm. A holed panel 4/6 which ensured rear ventilation of the cladding was located in the region of the window lintel. A strip of self-adhesive Exterdens® F 10×2 mm had been attached to this panel with the job of interrupting the rear ventilation in the event of fire and thus preventing flames acting on both sides of the cladding panels.

In a second experiment, further holed panels with Exterdens® F strips as fire barriers were additionally installed 0.5 m and 1.0 m above the window lintel.

Experimental Procedure

A 25 kg wooden (pine) crib (nailed) was placed in the region of the window reveal as fire load. The fire load was ignited using 2×200 ml of isopropanol. The wooden crib collapsed after about 20 minutes. The experiment was carried out over 30 minutes.

Thermocouples were Positioned 3 on the underside of the window lintel (left, right, center)

2 in the region of the rear-ventilation panel above the insulation layer former 2 0.5 m above the window lintel (fire barrier 2).

The fire space was additionally ventilated from the back.

Result

Experiment 1

The cladding achieved the aims of protection for multistorey buildings in accordance with German multistorey building guidelines. Little smoke was evolved during the experiment (evaporating binder)

Experiment 2

As for Experiment 1

The fire barrier 0.5 m above the window lintel had expanded fully and was thus able to prevent transport of hot gases. The fire barrier 1.0 m above the window lintel showed little reaction. However, the temperatures in this region were so low that expansion was not expected.

Result

The two experiments showed that fire barriers in rear-ventilated cladding effectively prevent ingress of flames into the rear ventilation and prevent transport of hot gases.

Example 8

Fire Test on a Rear-Ventilated Cladding Element

The following construction was selected for the rear-ventilated cladding system:

An aluminum subconstruction measuring 400×400 mm was assembled in the form of a double frame giving a rear-ventilation gap of 40 mm. A rockwool insulation (Rockwool, A2) with a thickness of 80 mm was laid in the rear wall of the frame construction. A commercially available Resopal® cladding board (HPL board, B1) from Resopal was screwed onto the front of the cladding (front of the frame construction). Two aluminum rails for accommodating the fire protection strips were riveted parallel to one another halfway up the insides of the frame construction.

The aluminum rails were of such a size that an Exterdens® FB strip measuring 400×16×2 mm (sk) could be introduced into its groove. The aim was for the rear-ventilation gap of 40 mm arising from the construction to be closed on heating owing to a horizontal foaming process.

Performance of the Experiment

The cladding element was positioned above two Bunsen burners in such a way that the upper edges of the burner were about 50 mm below the fire barriers. The Bunsen burners were placed centrally in the rear-ventilation space at a separation of 100 mm. A thermocouple was introduced into the rear-ventilation gap above the aluminum rails at a distance of 50 mm. On commencement of the flame treatment, a rapid increase in the temperatures to 480° C.–500° C. was measured.

After a few seconds (5–10 sec.), the intumescent system responded. A rapid movement of the thermofoam together resulted in closure of the rear-ventilation gap. The temperatures measured above the fire barriers dropped rapidly as a consequence to values between 190° C. and 198° C. After about 25–30 sec., the gap was completely blocked by foam over the entire width of the cladding elements.

The temperature measured was virtually constant at 195° C. over the entire experimental time. After 15 minutes, the fire experiment was terminated. The thermofoam formed proved to be compact and load-bearing.

During the experiment, no molten aluminum from the subconstruction was observed. Smoke evolution during the fire experiment was moderate. Furthermore, no falling-off or detachment of the cladding boards was observed.

We claim:

1. A rear ventilated cladding, comprising a building surface, an insulation layer and an outward-facing protective layer, wherein between the building surface and the insulation layer or between the insulating layer and the protective layer is a cavity for rear ventilation, which contains holed profiles as spacers, serving for mechanical stabilization of the cladding and allowing passage of air within the cavity, said holed profiles being provided with an intumescent composition, comprising the following components:

a) about 2 to 50% by wt. of a phosphorous-containing nitrogen compound selected from the group consisting of phosphates of ammonium, melamine, dimelamine, urea, dicyan diamide, carbamide and guanidine;

b) about 2 to 30% by wt. of a polyalcohol selected from the group consisting of glycerol, trimethylolethane, trimethylolpropane, tetraphenylethylene glycol, ditrimethylolpropane, 2,2-dimethylolbutanol, dipentaerythritol, tripentaerythritol, EO/PO-trimethylolpropane, EO/PO-pentraerythritol, sugars, and polysaccharides;

c) 2 to 15% by wt. of a blowing agent selected from the group consisting of melamine cyanurates, melamine phosphates, melamine borates, polyethyleneimines, carboxylic acids, dicarboxylic acids, calcium carbonate and ammonium carbonate; and d) about 0.5 to 50% by wt. of expandable graphite.

2. The rear-ventilated cladding of claim 1, wherein said holed profiles are provided with intumescent strips.

3. The rear-ventilated cladding of claim 1, wherein said holed profiles are made of a composite material containing at least one intumescent layer.

4. The rear-ventilated cladding of claim 1, wherein the holed profiles are coated with said intumescent composition.

5. The rear-ventilated cladding of claim 1, wherein said polysaccharides are selected from the group consisting of starch and cellulose.

6. The rear-ventilated cladding of claim 1, wherein said phosphorus-containing nitrogen compound is present in an amount of about 11 to 40% by wt.

7. The rear-ventilated cladding of claim 1, wherein said polyalcohol is present in an amount of about 5 to 18% by wt.

8. The rear-ventilated cladding of claim 1, wherein said blowing agent is present in an amount of about 2 to 10% by wt.

9. The rear-ventilated cladding of claim 1, wherein said phosphorus-containing nitrogen compound is selected from the group consisting of ammonium polyphosphates and melamine phosphate.

10. The rear-ventilated cladding of claim 1, wherein said polyalcohol is selected from the group consisting of pentaerythritol, dipentaerythroitol, a) about 2 to 50% by wt. of a phosphorous-containing nitrogen compound selected from the group consisting of phosphates of ammonium, melamine, dimelamine, urea, dicyan diamide, carbamide and guanadine;

b) about 2 to 30% by wt. of a polyalcohol selected from the group consisting of glycerol, trimethylolethane, trimethylolpropane, tetraphenylethylene glycol, ditrimethylolpropane, 2,2-dimethylolbutanol, dipentaerythritol, tripentaerythritol, EO/PO-trimethylolpropane, EO/PO-pentraerythritol, sugars, and polysaccharides;

c) 2 to 15% by wt. of a blowing agent selected from the group consisting of melamine cyanurates, melamine phosphates, melamine borates, polyethyleneimines, carboxylic acids, dicarboxylic acids, calcium carbonate and ammonium carbonate; and d) about 0.5 to 50% by wt. of expandable graphite;

and tripentaerythritol.

11. The rear-ventilated cladding of claim 1, wherein said blowing agent is selected from the groups consisting of melamine and melamine cyanurate.

12. The rear-ventilated cladding of claim 1, wherein said intemescent composition further comprises one or more water-liberating compounds, plasticizers, thickeners, flow-control agents, antifoams, adhesion promoters and rheological additives.

13. The rear-ventilated cladding of claim 12, wherein said one or more water-liberating compounds are selected from the group consisting of aluminum hydroxide, magnesium hydroxide, calcium hydroxide and barium hydroxide.

14. The rear-ventilated cladding of claim 1, wherein said intemescent composition further comprises one or more fire-protection additives selected from the group consisting of boron compounds, organohalogen compounds, metallocenes, azidodicarboxylic acid diamides, red phosphorus and organophosphorus compounds.

15. The rear-ventilated cladding of claim 1, wherein said intumescent composition comprises ammonium phosphate, dipentaerythroitol, dicyandiamide, expandable graphite, and aluminum hydroxide.

16. A construction element for the rear-ventilated cladding of claim 1, wherein at least one ventilation device or profile which allows passage of air is provided with said intumescent composition.

17. A process for conferring fire resistance on rear-ventilated cladding, which comprises providing ventilation devices or profiles, which allow passage of air, with an intumescent composition, comprising the following components:

a) about 2 to 50% by wt. of a phosphorous-containing nitrogen compound selected from the group consisting of phosphates of ammonium, melamine, dimelamine, urea, dicyandiamide, carbamide and guanadine;

b) about 2 to 30% by wt. of a polyalcohol selected from the group consisting of glycerol, trimethylolethane, trimethylolpropane, tetraphenylethylene glycol, ditrimethylolpropane, 2,2-dimethylolbutanol, dipentaerythritol, tripentaerythritol, EO/PO-trimethylolpropane, EO/PO-pentraerythritol, sugars, and polysaccharides;

c) 2 to 15% by wt. of a blowing agent selected from the group consisting of melamine cyanurates, melamine phosphates, melamine borates, polyethyleneimines, carboxylic acids, dicarboxylic acids, calcium carbonate and ammonium carbonate; and d) about 0.5 to 50% by wt. of expandable graphite.

* * * * *